United States Patent [19]

Gotanda

[11] Patent Number: 5,076,624

[45] Date of Patent: Dec. 31, 1991

[54] DOOR CHAIN DEVICE

[76] Inventor: Motohiro Gotanda, Chiba, Japan

[21] Appl. No.: 713,253

[22] Filed: Jun. 10, 1991

[51] Int. Cl.[5] ..... E05C 17/36

[52] U.S. Cl. ..... 292/264; 292/201

[58] Field of Search ..... 292/262, 251.5, 264, 292/201, 278; 70/93

[56] References Cited

U.S. PATENT DOCUMENTS

| | | | |
|---|---|---|---|
| 3,275,364 | 9/1966 | Quinn | 292/264 |
| 3,705,504 | 12/1972 | Johnson | 292/264 X |
| 3,944,268 | 3/1976 | Gonyaley et al. | 292/264 |

*Primary Examiner*—Richard E. Moore

*Attorney, Agent, or Firm*—Jordan and Hamburg

[57] ABSTRACT

A door chain device not allowing the disengagement of its engaged member from a door-side member by manipulating the chain from the outside. In the door chain device wherein a chain is fixed at one end to the door frame and has an engaging member at the other end, the engaging member has a flanged end which is inserted into a through hole made in the door-side locking member and then fitted into a slit extending from the through hole. The improvement is comprised of the flanged end having a permanent magnet, a door-side member having a bottom plate made of a ferromagnetic material, the bottom plate having an oval hole at a position corresponding to the through hole. Thereby when the flanged end reaches the oval hole the magnetic balance therein is broken to generate a magnetic force by which the flanged end is turned in the oval hole and therefore it cannot pass out from the hole.

4 Claims, 6 Drawing Sheets

DOOR CHAIN DEVICE

BACKGROUND OF THE INVENTION

The present invention relates to a door chain device capable of fastening a door chain to a door from the inside to prevent the door from being opened any more than the length of the chain to guard against the illegal entry of any stranger.

A conventional door chain device is usually constructed as follows:

A chain, composed of a limited number of links, is fixed at one end to a retaining means secured to a door frame and has an engaging member at the other end. Said engaging member is integrally formed of a head portion having a slit in which a cross pin is secured for fixing thereon the end link of the chain, a narrow neck portion and a flange of a larger diameter. A door-side locking member secured to the door has a surface plate integrally formed with a frame to form a space between the surface plate and the door's upper surface. The surface plate has a through hole for receiving the flange portion of the engaging member and a slit continuously formed therewith for allowing the narrow neck portion to slide therein. The door-side locking member is secured with bolts to the door.

The door chain can be fastened to the door in such a way that the flanged portion of the engaging member of the chain is inserted in the through hole of the door-side locking member and then its narrow neck portion is slidably fit in the slit of the door-side locking member, thereby the door and door frame are connected by the chain and the door cannot be opened more than the length of the chain even when the door is unlocked.

The chain can be released from the door by reversing the above-mentioned procedure, i.e. the engaging member is moved upward along the slit to the through hole of the door member and then is removed from the engaging member through the through hole by pulling its head portion up at the right angle to the door's surface.

However, the conventional door chain device has the drawback that when the door is opened to the limit the engaging member of the chain can be moved upwards along the slit of the door-side locking member and be pulled out of the through hole, i.e. the chain can be disengaged from the outside of the door.

SUMMARY OF THE INVENTION

It is an object of the present invention to provide a door chain device which is capable of fastening a door chain to the door from the inside so as to prevent the door from being opened any more than the length of the chain, thereby guarding against the possible illegal entry of strangers.

It is another object of the present invention to provide a door chain device which is not able to be disengaged from the outside but which can be easily released from the inside.

It is another object of the present invention to provide a door chain device which can be engaged and disengaged with only one hand on the inside but cannot be removed from the outside.

DETAILED DESCRIPTION OF THE PRESENT INVENTION

Figure 2:
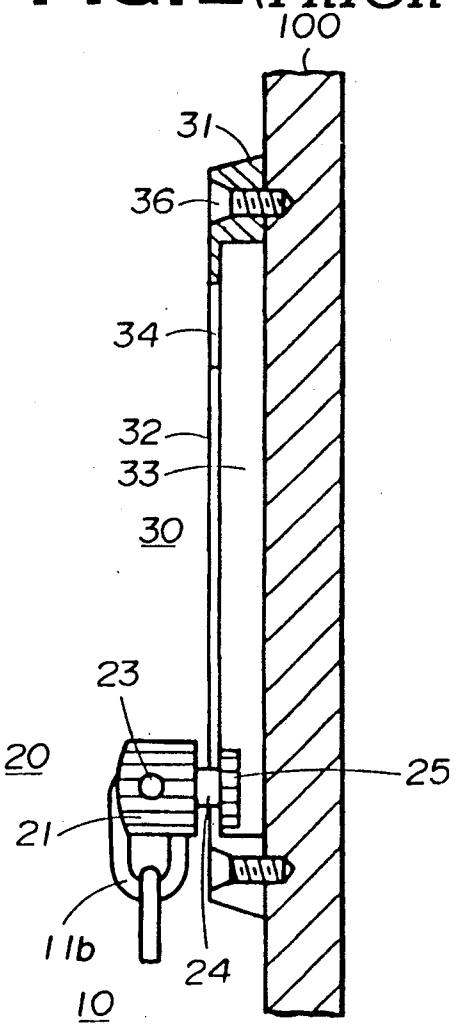
FIG. 2 (PRIOR ART)
FIG. 2 is a sectional side view of the door-side chain locking member of a door chain device shown in FIG. 1.
Figure 1:
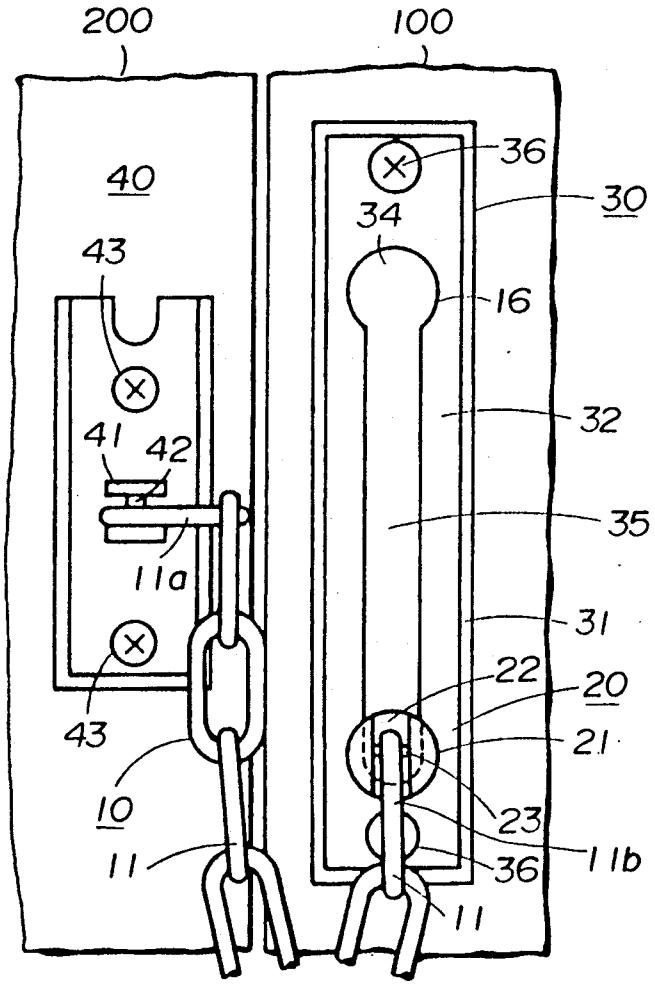
FIG. 1 (PRIOR ART)
FIG. 1 is a front view of the prior art of a door chain device.

FIG. 1 is a front view of an example of a conventional door chain device and FIG. 2 is a sectional side view of an engaging member of a conventional door chain. In these drawings, 100 is a door, 200 is door frame and 10 is a chain composed of a number of chain links 11. An end link 11*a* of the chain 10 is attached to a fixing member 40.

A chain 10 composed of a number of links 11 is fixed at one end link 11*a* to a fixing means, as will be mentioned later, and has an engaging member 20 attached to its other end link 11*b*. The engaging member 20 is integrally formed of a head portion 21 having a slit 22 in which a cross pin 23 is secured for fixing thereon the end link 11*b* of the chain 10, a narrow neck portion 24 and a flanged portion 25 of a diameter larger than that of the neck portion. A door member 30 secured to the door 100 has a surface plate 32 integrally formed with the frame 31 of a door to form a space 33 between the surface plate 32 and the upper surface of the door 100. The surface plate 32 has a through hole 34 for admitting the flanged portion 25 of the engaging member 20 in the space 33, and a slit 35 continuously formed therewith for allowing the narrow neck portion 24 to slide down therein. The door-side locking member 30 is secured to the door 100 with screws 36.

The fixing means 40 has a retaining portion 41 and a pin 42 fixing the end link 11*a* of the chain 10 thereon and is secured to the door frame 200 with screws 43.

The operation of the conventional door chain is as follows:

The door chain 10 can be fastened to the door 100 in such a way that the flanged portion 25 of the engaging member 30, held in one hand at its head portion 21, is inserted in the through hole 34 of a door side locking member 30 and then its narrow neck portion 24 is slid into a slit 35 of the door side locking member 30, thereby door 100 and door frame 200 are connected by the chain 10 so that the door 100 cannot be opened any more than the length of the chain 10, even when the door is unlocked.

The chain 10 can be disengaged from the door 100 by reversing the above-mentioned procedure, i.e. the head portion 21 of the engaging member 20 is moved upward along the slit 35 to the through hole 34 of the door-side locking member 30 and then is pulled up at a right angle to the door's surface to disengage the engaging member 20 from the door-side locking member 30.

However, the above-mentioned conventional door chain device has the drawback that when the door 100 being in narrowly open state that it is possible to manipulate the chain 10 from the outside through the door's opening and to move the engaging member 20 of the chain 10 upwards along the slit 35 of the door-side locking member 20 and then to pull it out through the through hole 34, from the door side locking member i.e. the chain can be disengaged from the outside.

Figure 5:
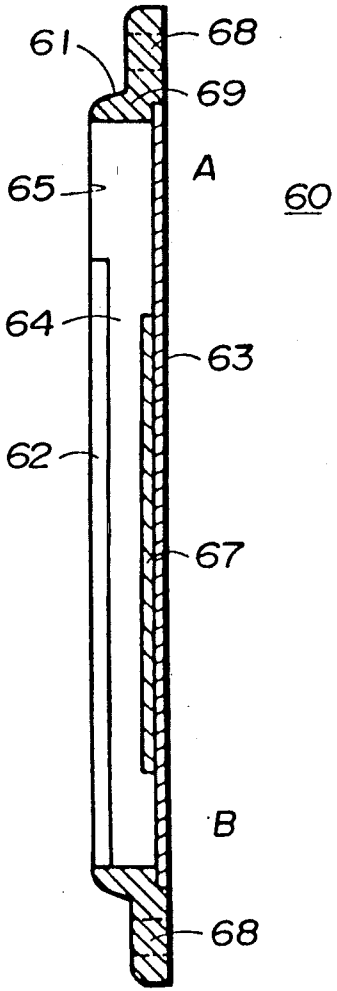
FIG. 5 is a sectional side view of the chain locking member shown in FIG. 3.
Figure 4:
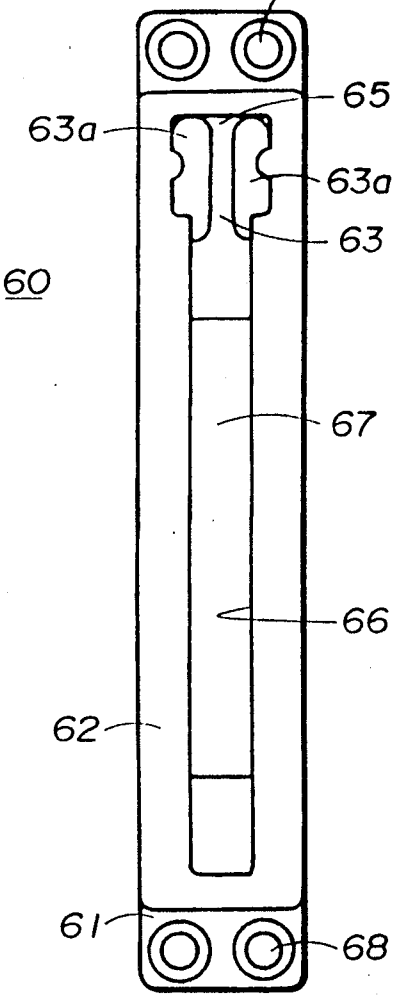
FIG. 4 is a plane view of the embodiment of a door-side chain locking member used in the present invention.
Figure 3A:
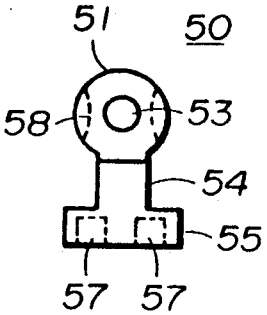
FIGS. 3(*a*) to 3(*c*), are views of the embodiment of an engaging member used in the present invention.
Figure 3B:
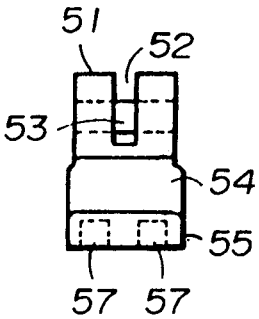
Figure 3C:
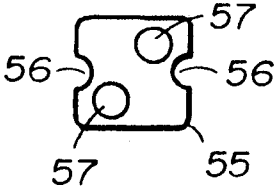
Figure 6:
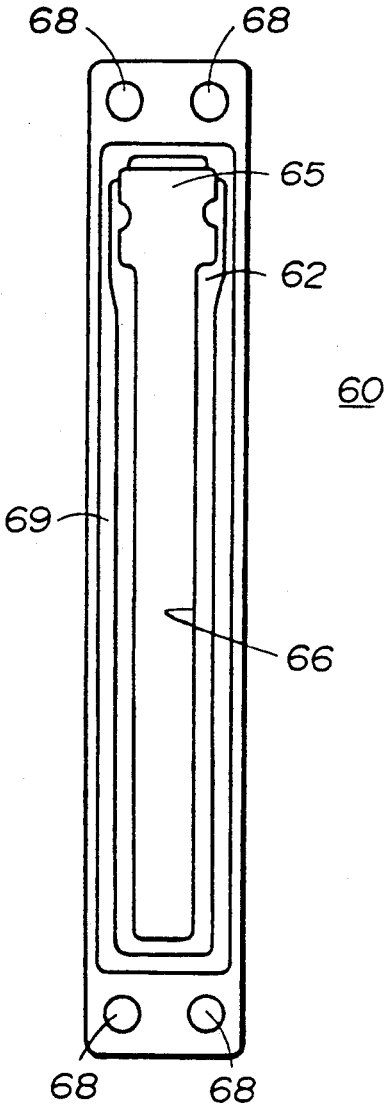
FIG. 6 is a rear view of the chain locking member shown in FIG. 3.
Figure 7:
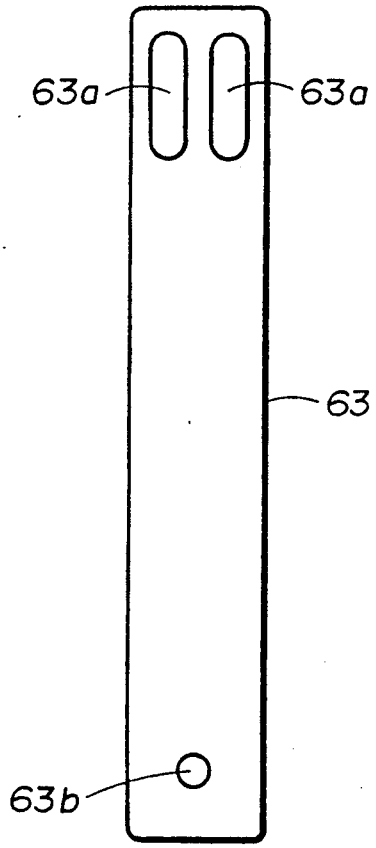
FIG. 7 is a plane view of the bottom plate of the chain locking member shown in FIG. 5.
Figure 8:
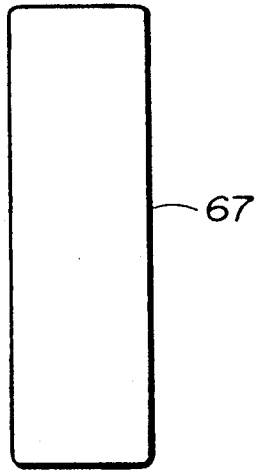
FIG. 8 is a plane view of the stopper of the chain locking member shown in FIG. 5.

Referring now to FIGS. 3 to 13, there is shown an embodiment of the present invention. FIGS. 3(*a*),(*b*) and (*c*) are respectively the front, side and bottom views of an engaging member, FIGS. 4 and 5 are respectively a top view and a sectional side view of a door-side locking member. FIG. 6 is a bottom view of said door-side locking member with its bottom plate remove; FIGS. 7 and 8 are plane views of the bottom plate and the stopper respectively, and FIGS. 9 to 13 are views for explaining the operation of the embodiment of the present invention.

Referring first to FIGS. 3(*a*), (*b*) and (*c*), there is shown an engaging member 50 which has a head portion 51 with a slit 52 formed thereon for holding a cross pin 53 whereto one end link of a chain 10 (not shown) is attached, a narrow neck portion 54 extending from the head portion and a flange 55 integrally formed at the end of the narrow neck portion 54. The flange 55 has a plane surface of a non-circular, e.g. square form as shown in FIG. 3(*c*), and has two concave surfaces 56 formed at the opposite sides. Two pieces of magnetic substances 57, e.g. permanent magnets or iron pieces are embedded in the plane surface of the flange 55 so as to provide for the turning operation of the engaging member 50. The head 51 has arched concave surfaces 58 on both sides for the convenience of holding it with one's fingers. The engaging member 50 is made of non-magnetic material such as aluminum (a metal) or polycarbonate (a non-metal).

Referring next to FIGS. 4 to 8, there is shown a door-side locking member 60 which comprises a frame 61, a surface plate 62 formed integrally with or separately from the frame 61 and a bottom plate 63 made of a ferromagnetic material. The surface plate 62 and the bottom plate 63 provide therebetween enough space 64 to allow the flanged portion 55 of the engaging member 50 to smoothly slide therein. The surface plate 62 has a through hole 65 and a slit 66 extending therefrom. The through hole 65 is similar in shape to the flange 55 but somewhat larger in size than the flange 55 so that the flange may pass into the hole 65. The slit 66 is wide enough to permit the sliding in of the narrow neck portion 54 of the engaging member 50. The bottom plate 63 has a stopper 67 formed thereon. The flanged portion 55 of the engaging member 50 slides in the space limited by the stopper 67 and the surface plate 62. There are two pairs of mounting holes 68 in the frame 61. As shown in FIG. 7, two oval holes 63*a* are formed parallel to each other in the bottom plate 63. When the flanged portion 55 of the engaging member reaches the oval holes, the magnetic forces are unbalanced for turning the flanged portion 55. The bottom plate 63 is fitted into a recessed area 69 as shown in FIGS. 5 and 6.

The operation of the device is as follows:

An end link 11*a* of the chain 10 is fixed to the door frame 200 by means of a fixing member 40, and the other end link 11*b* of the chain 10 is fixed to a pin 53 fitted in the slit 52 of the engaging member 50.

The engaging member 50 can be engaged with the door-side locking member 60 in such a way that the flanged portion 55 of the engaging member 50, with its head portion 51 being held, is entered into the door-side locking member 60 through the through hole 65 and then its narrow neck portion 54 is moved along the slit 66 to any desired point i.e. A or B as shown in FIG. 5 wherein the flanged portion 55 is pushed down to the bottom plate 63 to be firmly kept there by a magnetic force produced between the permanent magnet 57 of the engaging member 50 and the bottom plate 63 made of a ferromagnetic material. The degree of the door opening is decided by the selection of a fixed point i.e. A or B in the door-side locking member because of a variation in the relative distance from the fixing plate 40 on the door frame 200.

When the engaging member 50 is fixed at point B in the door-side fixing member 60 it is impossible to disengage the engaging element 50 from the fixing member 60 by pulling the chain 10 from the outside because the flanged portion 55 of the engaging member 50 abuts the stopper 67. Concerning the way of selecting the fixed point A, it will be described later.

The engaging member 50 can be disengaged from the door-side locking member from inside in such a way that the head portion 51 of the engaging member 50 is pulled to separate the flange 53 from the bottom plate 63 and abut it against the rear surface of the surface plate 62, and then it is displaced upwards to the through hole 65 without interference by the stopper 67, wherethrough the engaging member 50 is removed.

In many conventional door chain devices both the engaging member 50 and the through hole 65 of the door-side locking member 60 are of a circular shape. Consequently, even if the door opening is limited by the door chain, the engaging member 50 may be moved with a state abutting against the rear surface of the surface plate 62, to the through hole and disengaged therefrom from the outside by means of a rod or a string. According to the present invention, such a drawback of the prior art can be eliminated as will be mentioned below with reference to FIGS. 9 to 13.

Figure 12:
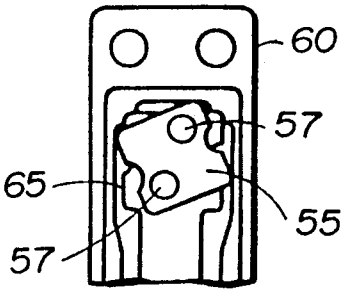
FIG. 12 is an illustration for explaining the operation of a door chain device according to the present invention.
Figure 10:
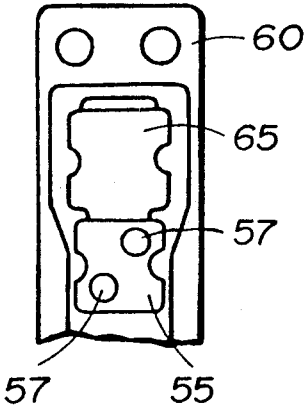
FIG. 10 is an illustration for explaining the operation of a door chain device according to the present invention.
Figure 11:
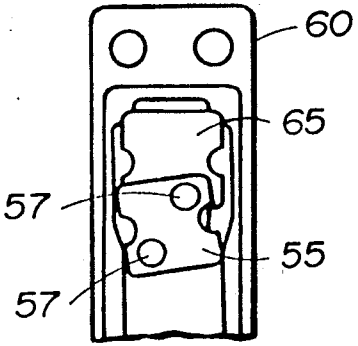
FIG. 11 is an illustration for explaining the operation of a door chain device according to the present invention.
Figure 9:
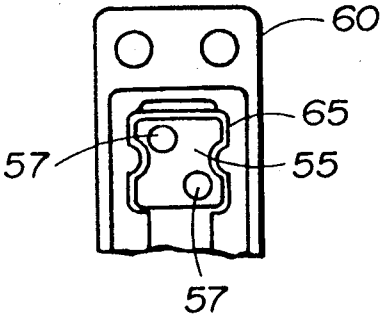
FIG. 9 is an illustration for explaining the operation of a door chain device according to the present invention.
Figure 14B:
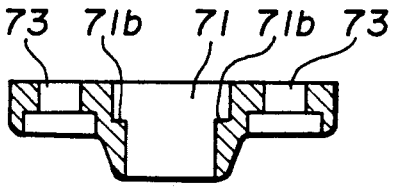
FIGS. 14(*a*) to 14(*d*) are views of an embodiment of a chain fixing means used together with a chain member according to the present invention.
Figure 14A:
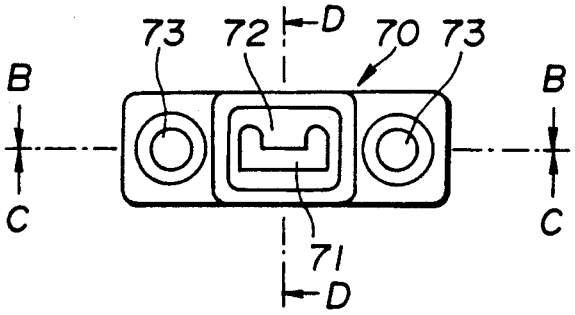
Figure 14D:
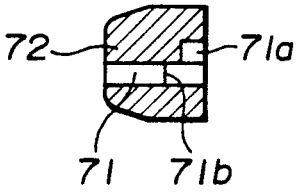
Figure 14C:
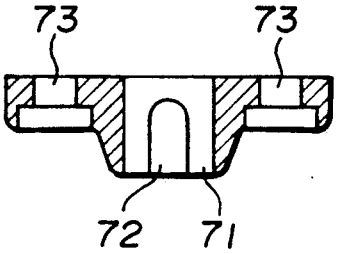

FIGS. 9 to 13 are rear views for explaining the relationship between the door-side locking member 60 and the chain engaging member 50. The chain engaging member 50 can be easily engaged with the door-side locking member 60 by putting the flanged portion 53 in the through hole 65 as shown in FIG. 9, and then by sliding it in the locking member as shown in FIG. 10. The flanged portion 55 can be also easily taken out of the door-side locking member if the chain-engaging member 50 is correctly held by hand and displaced from the position shown in FIG. 10 to the position shown in FIG. 9 wherefrom it may be pulled out. However, if the chain-engaging member is incorrectly lifted by means of a string or the like to the upper end position on the bottom plate 63, whereat two oval holes 63*a* are made parallel to each other as shown in FIGS. 4 and 7, a magnetic force between the diagonally disposed permanent magnets 57 of the flange 55 and the ferromagnetic bottom plate 63 becomes unbalanced to produce a magnetic force for turning the flange 55 as shown in FIG. 11. A further displacement of the engaging member 50 to the through hole causes further turning of the member as shown in FIG. 12, resulting in that its flange 55 cannot line up with the through hole and therefore cannot be taken out from the locking member by pulling it up at a right angle to the bottom plate. Namely, it is impossible to disengage the flange 55 of the engaging member 50 from the locking member in such an irregular manner.

Figure 13:
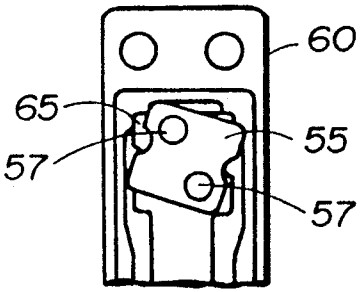
FIG. 13 an illustration for explaining the operation of a door chain device according to the present invention.

FIG. 13 shows a case in which the flange 55 is turned in the reverse direction to the case as shown in FIG. 11. The direction in which the flange 55 will turn depends upon its instantaneous state.

Although in the above-mentioned embodiment of the present invention a magnetic force of attraction to be produced between a permanent magnet 57 and a magnetic material is applied for turning the flange 55 of the chain-engaging member 50, it is also possible to use any turning means, e.g. permanent magnets repelling each other, springs and other mechanical means. In the above-mentioned embodiment, there is used an engaging member 50 which has permanent magnets 57 embedded in its flange portion 55, but it is also possible to use such a combination of a ferromagnetic flange 55 and a bottom plate 63 permanently magnetized at specified intervals in its lengthwise direction. Namely, any combination of the components is available if they may magnetically attract each other and turn the flange 55 when the last one reaches the through hole position. The number and locations of the stoppers 67 can be optionally selected. Furthermore, it is also possible to use non-magnetic materials for any portions wherein a magnetic force is unnecessary, i.e. other than the permanent magnets 57 and the bottom plate 63. The flange 55 and the through hole may have any kind of non-circular shape as for example, they may be of a partially bulged circular form.

As is apparent from the foregoing description, since the door chain device according to the present invention, includes a chain-engaging member having a head portion and a narrow neck portion with a flange of a larger diameter; a door-side locking member having a surface plate and a bottom plate on the door's surface for a space wherein the engaging member is loosely fitted at its flanged portion through the through hole made in the surface plate and slidable along a slit cut in the surface plate downward from the through hole, and also having a turning means for turning the flange of the chain engaging member so as to prevent the flange from slipping off the door side locking member when it reaches the through hole, it is possible to fasten and release the chain lock by on hand from the inside but it is impossible to release the chain lock from the outside.

Referring to FIG. 14, there is shown an example of a fixing means to be secured to the door frame. FIG. 14(*a*) is a plane view of the fixing means and FIGS. 14(*b*),(*c*) and (*d*) are sectional views taken along lines B—B, C—C and D—D respectively of FIG. 14(*a*).

Figure 15:
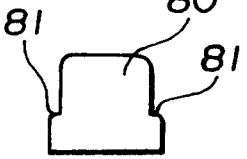
FIG. 15 is a plane view of an embodiment of a plate member used in the fixing means shown in FIG. 14.

FIG. 15 is a plane view of a plate member which is used together with the fixing means shown in FIG. 14 for fixing one end link of the chain to the door frame.

Figure 16C:
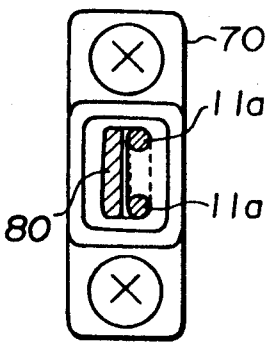
FIGS. 16(*a*) to 16(*c*) are views for explaining the procedure for fastening a chain by the use of a fixing means.
Figure 16B:
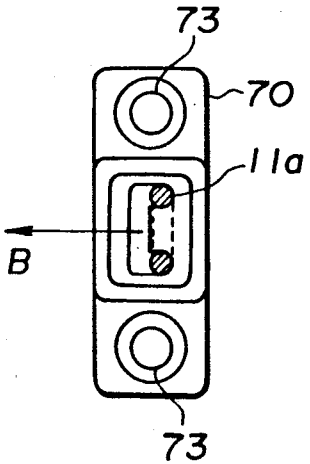
Figure 16A:
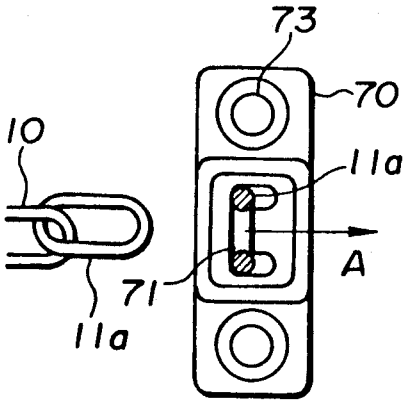

FIG. 16 is a view for explaining the procedure of fixing one end of the chain to the door frame by the use of a fixing means and a plate member. In FIG. 16, 70 is a fixing means, 80 is a plate member and 10 is a chain. The chain 10 is fixed at its end 11*a* to the fixing means 70. Before the fixing means 70 is secured to the door frame the chain 10 is cut to a desired length and its end link 11*a* is inserted into a bore 71 as shown in FIG. 16(*a*) and then is pushed in the direction of arrow A to the position shown in FIG. 16(*b*), wherein the link 11*a* is placed under a locking member 72. Therefore, the link 11*a* cannot be pulled out therefrom unless it is returned to the direction B. The plate member 80 serves to prevent the link 11*a* from returning to direction B. It is inserted into the bore 71 from the rear side of the fixing means 70. Since the plate member 80 abuts at its shoulder portion 81 on the bore's shoulder 71*b*, it cannot slip off the bore 71. The fixing member 70, in such state, is secured to the door frame with screws inserted into mounting holes 73. Accordingly, the application of this fixing means 70 makes it possible that a chain cut with a cutter to a desired length may easily be fixed to the door frame at a low cost without the aid of a workman.

I claim:

1. A door chain device comprising a chain fixed at one end to a fixing plate secured to a door frame and having an engaging member attached to its other end for engaging with a door-side locking member, secured to a door, characterized in that the engaging member has a head portion having a narrow neck extending therefrom and terminating at a flanged end which has non-circular shape on its' plane and a size larger than that of the narrow neck, the door-side locking member has a surface plate and a bottom plate located on the door's surface to form therebetween a space wherein the engaging member can be loosely fitted, said surface plate has a through hole cut at its upper side for admitting the flanged end of the engaging member and a slit extending downward therefrom for allowing the narrow neck portion of the engaging member to slide therealong, and a turning means is provided for turning the flanged end of the engaging member at the upper end of the bottom plate of the door's side locking member so as to prevent the flanged end of the engaging member from coming out through the through hole.

2. A door chain device as described in claim 1, characterized in that the turning means represents a magnetic force generated between a permanent magnet secured to the bottom surface of the flanged end of the engaging member and the bottom plate made of magnetic sheet in the door side locking member.

3. A door chain device as described in claim 1, characterized in that the turning means represents a magnetic force generated between the flanged end made of ferromagnetic material and the magnetized bottom plate.

4. A door chain device as described in claim 1, characterized in that the fixing plate includes a member having a bore wherein a fixed end link of the chain is fitted and a locking portion to where the link is moved for preventing the removal of the link from the bore, and a plate member for preventing the link fitted into the bore from returning to the initial state before bringing it into the locking portion.

* * * * *